United States Patent [19]

Pergler et al.

[11] 4,375,301

[45] Mar. 1, 1983

[54] CHAIR SEAT ADJUSTMENT ASSEMBLY

[75] Inventors: Charles C. Pergler, Grand Rapids; Jack R. Knoblauch, Byron Center, both of Mich.

[73] Assignee: Steelcase Inc., Grand Rapids, Mich.

[21] Appl. No.: 145,624

[22] Filed: May 1, 1980

[51] Int. Cl.[3] ..... A47C 11/02

[52] U.S. Cl. ..... 297/313; 248/371

[58] Field of Search ..... 297/313, 337, 309, 408, 297/409; 248/371, 397

[56] References Cited

U.S. PATENT DOCUMENTS

| | | | |
|---|---|---|---|
| 178,720 | 6/1876 | Brintnall | 248/371 |
| 1,415,252 | 5/1922 | McManis et al. | 297/313 X |
| 2,638,150 | 5/1953 | May | 297/313 |
| 4,155,593 | 5/1979 | Swenson et al. | 297/284 |
| 4,190,290 | 2/1980 | Strien | 297/408 |
| 4,214,726 | 7/1980 | Karrip et al. | 248/575 |

*Primary Examiner*—Francis K. Zugel

*Attorney, Agent, or Firm*—Price, Heneveld, Huizenga & Cooper

[57] ABSTRACT

The specification discloses a seat pitch adjustment assembly which a user can adjust upwardly or downwardly with basically the same applied force. A seat support is pivotally mounted with respect to a supporting assembly at one point and is joined thereto at another point through a pivot bracket. The pivot bracket is pivotally mounted to the support assembly on one pivot axis and to the seat support on a second pivot axis. The pivot bracketing includes a cylindrical wall defining at least a portion of the wall of a right circular cylinder whose axis of revolution lies on the aforesaid second pivot axis. The cylindrical wall includes at least one helically oriented slot receiving a projection from a slide slidably mounted on the seat support member whereby movement of the slide one way or the other rotates the pivot bracket about said second pivot axis and thereby changes the relative elevation of the first pivot axis with respect thereto. This in turn changes the pitch of the seat support with respect to the underlying support assembly and thereby changes the pitch of a seat mounted thereon.

9 Claims, 14 Drawing Figures

CHAIR SEAT ADJUSTMENT ASSEMBLY

BACKGROUND OF THE INVENTION

The present invention relates to mechanisms for chairs which adjust the pitch of the seat from front to rear. Often, different users of the same chair would like the chair to be pitched differently. Some might like the front lip of the chair to be higher and others might like it to be lower.

A number of cumbersome alternatives have been proposed in prior art patents for achieving these results, although it is not known whether any have been utilized commercially. U.S. Pat. No. 3,362,746 to Huyge issued Jan. 9, 1968 discloses a ratchet type mechanism for adjusting the pitch of a vehicle seat. The two U.S. Pat. Nos. to Costin, 4,054,318 issuing Oct. 18, 1977 and 3,954,245 issuing May 4, 1976, both disclose a cam type of arrangement for changing the elevation of the front of a seat. U.S. Pat. Nos. 2,221,268 to Sears issued Nov. 12, 1940, 2,638,150 to May issued May 12, 1953 and 2,646,839 to Hillman issued July 28, 1953 similarly disclose cam arrangements for changing the elevation of the front of a vehicle seat, and therefore for changing the pitch of the seat.

U.S. Pat. No. 4,076,308 to Slabon et al issued Feb. 28, 1978 introduces a seat pitch adjustment mechanism into a chair control. Chair controls normally function solely to control the rate of tilting of an office type chair. In the Slabon proposed mechanism, wedge blocks slide on ramps and are held in place by bolts. The bolts can be loosened with a tool so that the wedges can be slid to thereby change the pitch of the seat.

All of these mechanisms are cumbersome and tedious to operate. A noticeably greater force is required to adjust the pitch of the seats up than down. The Slabon mechanism is particularly tedious in that one has to first loosen bolts, slide wedges up or down a ramp, then make certain that both wedges are slid equally so that the pitch adjustment is the same on either side of the seat, and then retighten the bolts.

SUMMARY OF THE INVENTION

The present invention comprises a chair seat pitch adjustment assembly in which the force which the user must apply to effect adjustment is basically the same whether he is adjusting the pitch upwardly or downwardly. The adjustment means employed in the assembly of the present invention includes a pivot bracket pivotally mounted to a first support means on one pivot axis and to a seat support member on a second pivot axis. The seat support member is in turn pivotally mounted at yet another spaced point to the first support means. The pivot bracket includes a cylindrical wall extending generally laterally relative to the sides of the seat support. The cylindrical wall defines at least a portion of the wall of a right circular cylinder whose axis of revolution lies on the aforesaid second pivot axis. This cylindrical wall includes at least one helically oriented slot therein. A slide member is slidably mounted on the seat support member and includes projection means projecting through the helical slot whereby as the slide is moved laterally, the cylindrical wall and accordingly the pivot bracket are rotated about the second pivot axis, thereby changing the relative elevation of the first pivot axis with respect thereto, and thereby effectively changing the pitch of a seat mounted on the seat support.

These and other objects and advantages will be more fully understood and appreciated by reference to the written specification and appended drawings.

DESCRIPTION OF THE PREFERRED EMBODIMENT

Figure 1:
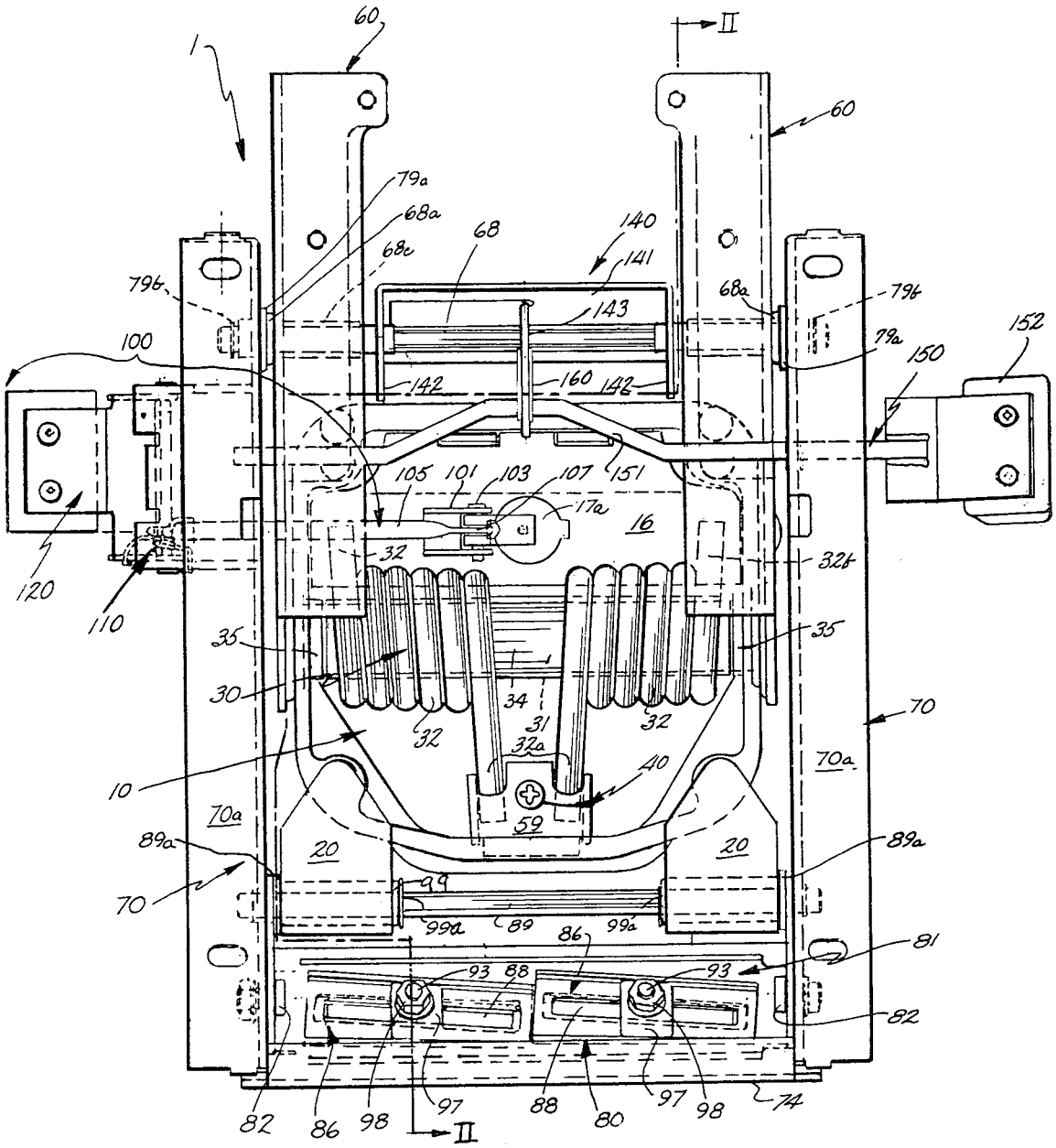
FIG. 1 is a plan view of a chair control made in accordance with the present invention.
Figure 2:
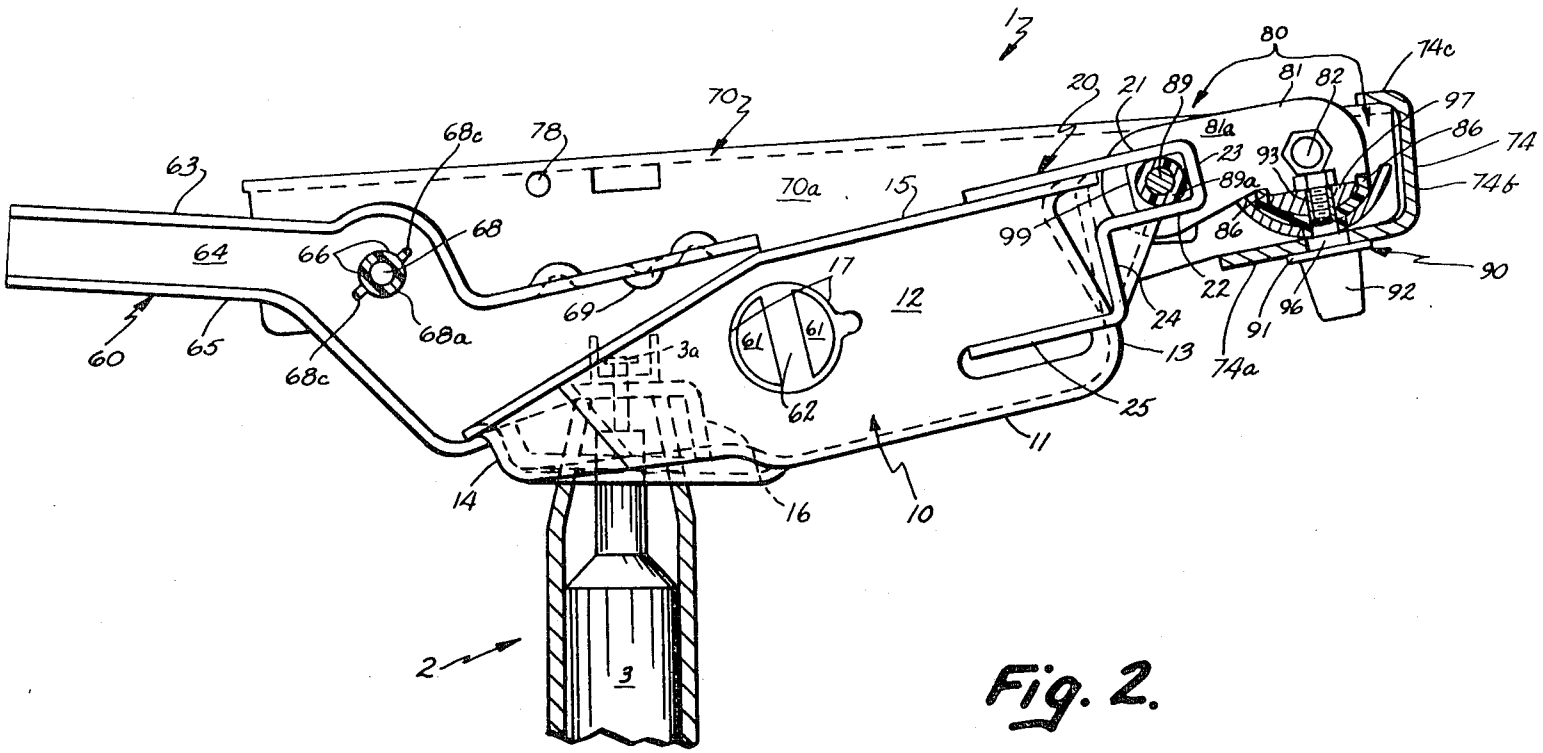
FIG. 2 is a fragmentary cross-sectional view taken generally along planes II—II of FIG. 1, showing only the right side seat support stretcher and back support arm (as viewed in FIG. 1) and eliminating the bias means 30, the tension bolt assembly 40, the pneumatic cylinder adjustment assembly 100, 110, 120 and 130, and eliminating the back upright lock assembly 140, 150 and 160.
Figure 3:
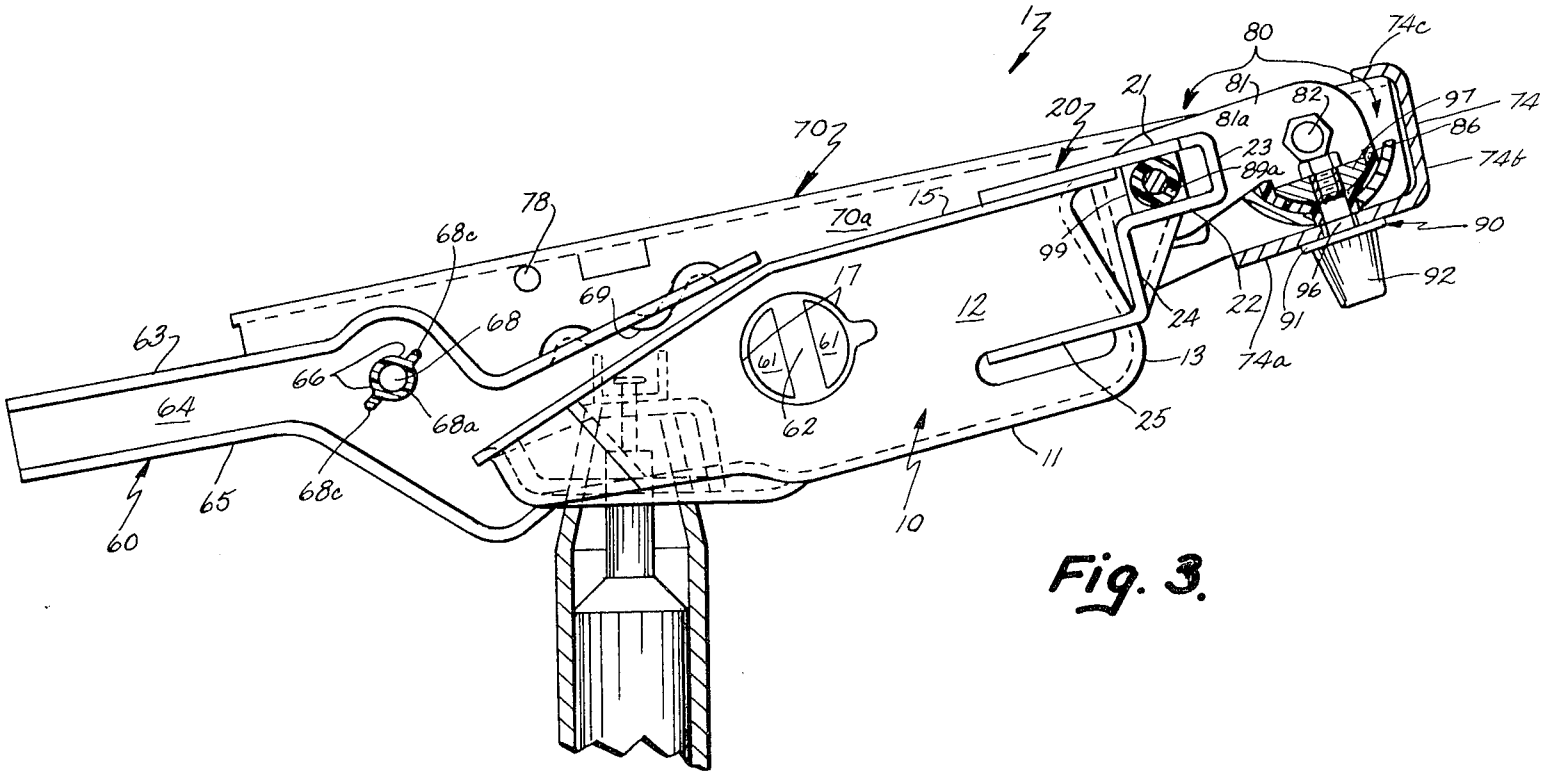
FIG. 3 is the same view as FIG. 2, but with the chair control in the position which it assumes when a person leans back in a chair to which the chair control is attached.
Figure 4:
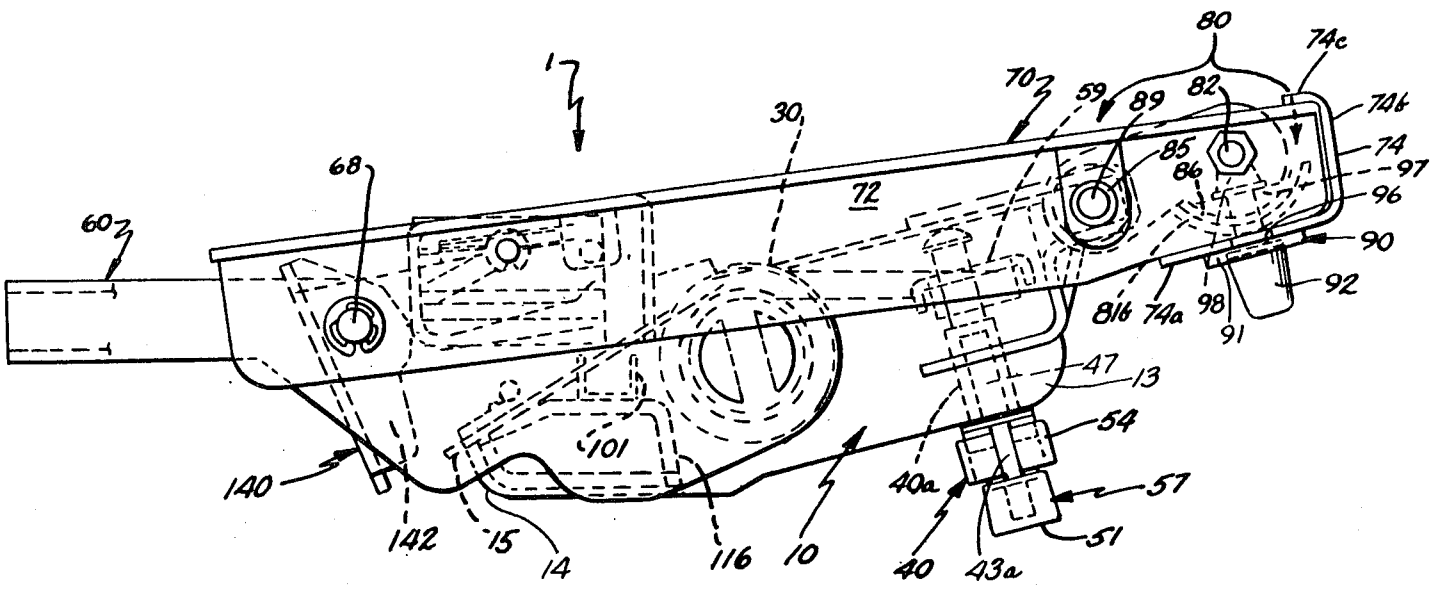
FIG. 4 is a side elevational view of the chair control with some of the internal components being shown in hidden lines.
Figure 5:
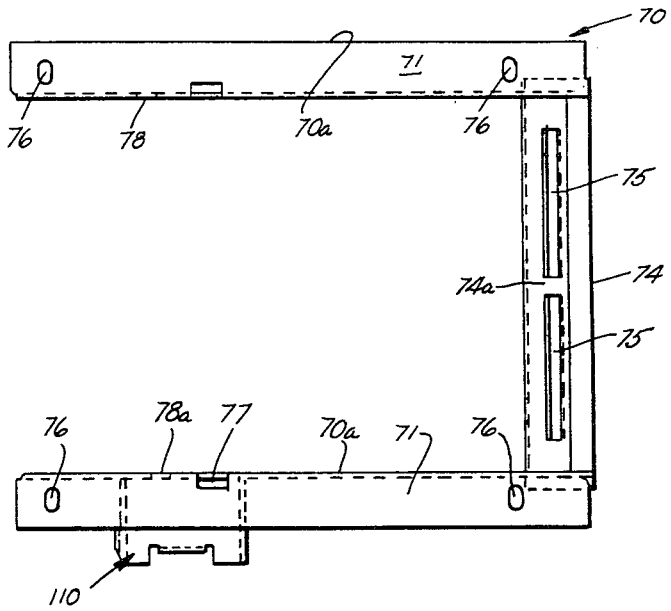
FIG. 5 is a top plan view of the chair seat supporting assembly 70.

In the preferred embodiment, the seat adjustment assembly of the present invention is incorporated into a chair control 1 (FIGS. 1–4). Chair control 1 comprises a stationary control housing 10 which houses a bias means 30 (FIGS. 1 and 4). The degree of pretension on bias means 30 is controlled by tension bolt assembly 40. Chair back support arms 60 are secured to the ends of the arbor 31 of bias means 30 and pivot with respect to stationary control housing 10. Chair seat support stretcher assembly 70 is pivotally mounted at its rear directly to back support arms 60. The front of seat support assembly 70 is slidably mounted within tracks 20 on the front of stationary control housing 10. This slidable mount is through seat adjustment assembly 80 described more fully hereinbelow. Seat adjustment assembly 80 is the key feature of chair control 1 with respect to the present invention.

In the broader aspects of the present invention, seat support 70 could be mounted pivotally directly to stationary member 10 rather than to back support arms 60 which in turn are mounted pivotally to stationary member 10. Alternatively for purposes of the present invention, one might simply think of back support arms 60 as part of a first support assembly with stationary control housing 10.

Further, the invention would not have to be incorporated into a chair control and accordingly in its broader aspects, bias means 30 could be eliminated. Other features are shown in the drawings which may be briefly referred to below which are desirable, but which are not essential to the present invention. Hence, they are not described in detail herein.

Stationary control housing 10 is a stamped or otherwise formed metal dish having a bottom wall 11, side walls 12, a front wall 13 and rear wall 14 (FIGS. 2 and 3). A lip 15 extends around the upper periphery (see FIG. 2). There is an aperture in bottom 11 through which the upper end of column 2 extends. A mounting plate 16 is welded to the inside of housing 10 and includes an aperture 17*a* therein to also receive the upper end of column assembly 2 (FIGS. 1 and 2).

Projecting forwardly from front wall 13 are a pair of track brackets 20. These are formed of metal by bending them so as to define a top wall 21, a bottom wall 22 and a front wall 23. These basically define the track in which seat support assembly 70 is slidably mounted. Extending downwardly from bottom wall 22 is a front brace 24 and then bent inwardly from front brace 24 to form the bottom brace 25. The rear portion of top wall 21, front brace 24 and bottom bracket 25 are welded to stationary control housing 10 to hold track brackets 20 in place.

Bias means 30 comprises a torsional coil spring arrangement. An arbor 31 which is generally circular in cross-sectional configuration extends through holes 17 in side walls 12 of stationary control housing 10 (compare to FIGS. 1 and 2). Arbor 31 is actually hidden in FIG. 1 since it is covered by a plastic sleeve 34. The ends of arbor 31 are rotatably carried in end bearings 35 which are located within side wall holes 17. Coiled around arbor 31 and sleeve 34 are a pair of coil springs 32. The front ends 32*a* of coil springs 32 are captured under retainer nut 59 of tension bolt assembly 40, captured in notches and between the side walls thereof. The rear ends 32*b* of springs 32 are captured under the chair back support arms 60. Tension adjustment is achieved by tightening or loosening tension bolt 40 in retainer nut 59. Basically, tension adjustment bolt assembly 40 comprises a bolt 40*a* having a hollow shank normally housing a lever 47. One can grasp a gripping cap 51, retract lever 47, pivot it to one side into a slot 43*a* and rotate it to thread bolt 40*a* up or down in retainer 59.

Chair back support arms 60 are formed of metal and are preferably channel shaped in cross section having a top wall 63, a side wall 64 and a bottom wall 65 (FIG. 2). There are two such chair back mounting arms 60, one located on either side of stationary housing 10 (FIG. 1). The generally channel shape cross section allows one to slip a chair back support frame or arm into the channels.

The arbor mounting hole or holes 61 in the side wall 64 of chair back support arm 60 is visible through the hole 17 in the side of stationary housing 10 in FIG. 2. There are two semi-circles 61 spaced by a bridge 62. The ends of arbor 30 are slotted so that they fit into the semi-circles 61. In this way, chair back support arms 60 are fixed against rotation with respect to arbor 30 and as one tilts back in the chair, chair back support arms 60 pivot and arbor 30 rotates within its plastic end bearings 35.

On top wall 63 of each support arm 60, located toward the front thereof are a pair of downwardly projecting dimples or protrusions 69 (FIG. 2). The rear end 32*b* of each coil spring 30 is captured between dimples 69. The other protrusions shown projecting up from top wall 63 are merely reinforcing ribs.

Located about midway along the length of each chair back support arm 60 is a hole 66 which is adapted to receive the rear axle 68 and suitable bearing 68*a*. It is on rear axle 68 that the rear of chair seat support assembly 70 is pivotally carried.

The chair seat support assembly 70 comprises a pair of spaced stretchers 70*a* joined at the front by front piece 74 (FIGS. 1, 2, 5 and 6). Each side stretcher 70*a* is formed of steel to define a top ledge 71 and a side wall 72. There are mounting holes 76 in top ledges 71 to facilitate mounting chair control 1 to the bottom of a chair seat.

Located towards the rear of each side wall 72 of each stretcher 70*a* is a rear axle receiving hole 79 (FIG. 6) which receives the end of rear axle 68 carried in a suitable plastic bearing of "T" shaped longitudinal cross section 79*a* (FIG. 1). Of course, suitable retainer clips 79*b* or the like then hold rear axle 68 in position (hidden in FIG. 1).

The front piece 74 which is welded to and thereby joined to side stretchers 70*a* is generally "J" shaped having a bottom wall 74*a*, a front wall 74*b* and a top lip 74*c*. Bottom wall 74*a* includes a pair of spaced slots 75 therein for cooperating with components of seat adjustment assembly 80. One slot is located toward one side stretcher 70*a* and the other slot towards the other.

Figure 6:
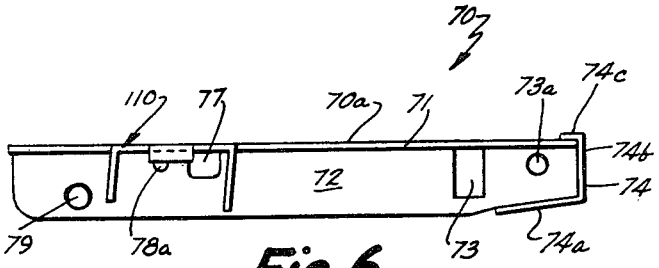
FIG. 6 is a side elevational view thereof.

Another feature of seat stretcher 70 which is especially adapted to cooperate with seat adjustment assembly 80 is the large generally rectangular opening 73 towards the front of each side wall 72 of each stretcher 70*a* (FIGS. 4 and 6). The forwardmost holes 73*a* in each side wall 72 of each stretcher 70*a* similarly facilitate mounting of seat adjustment assembly 80 to stretcher assembly 70. The details of this cooperation are set forth more fully hereinbelow.

Seat adjustment assembly 80 comprises first of all a pivot bracket 81 which is pivotally mounted between side stretchers 70*a* of stretcher assembly 70 via pivot nut, bolt and washer assemblies 82 through holes 73*a* (FIGS. 1, 2, 7 and 8). Pivot bracket 81 comprises a pair of spaced, short legs 81*a* joined by a cylindrical bottom wall 81*b*. All are formed of metal and are welded together or alternatively formed from a single piece.

Figure 7:
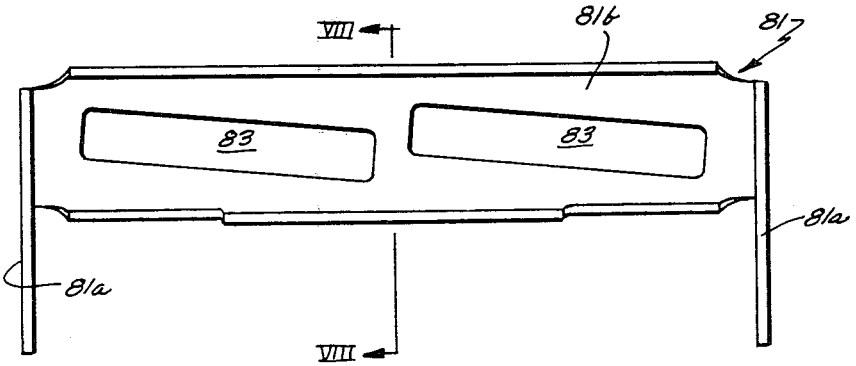
FIG. 7 is a top plan view of the seat adjustment pivot bracket 81.
Figure 8:
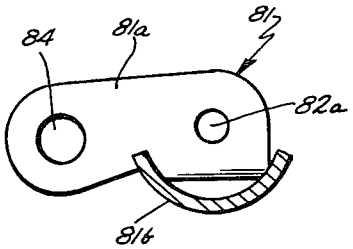
FIG. 8 is a cross-sectional view thereof taken along plane VIII—VIII of FIG. 7.
Figure 9:
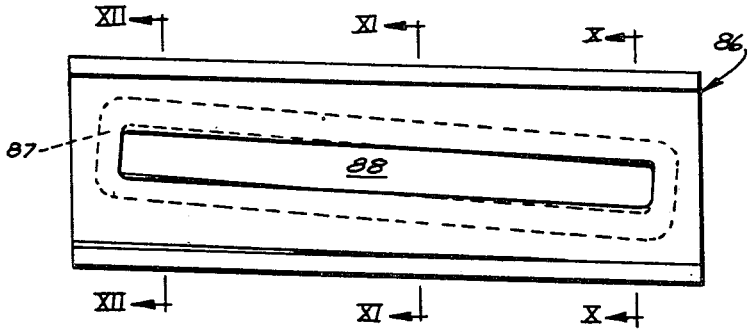
FIG. 9 is a top plan view of the pivot bracket insert 86.
Figure 10:
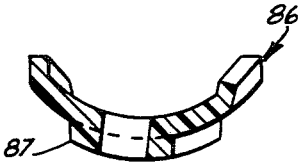
FIG. 10 is a cross-sectional view thereof taken along plane X—X of FIG. 9.
Figure 11:
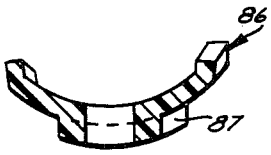
FIG. 11 is a cross-sectional view thereof taken along plane XI—XI of FIG. 9.
Figure 12:
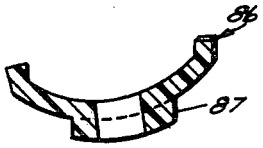
FIG. 12 is a cross-sectional view thereof taken along plane XII—XII of FIG. 9.

The hole 82*a* towards the front of each side wall 81*a* through which the bolt of nut, bolt and washer assembly 82 passes can be seen in FIG. 8. Referring to FIG. 7, it will be seen that there are a pair of spaced slots 83 in bottom wall 81*b* of pivot bracket 81. Each slot 83 is generally spirally or helically oriented in the cylindrical bottom wall 81*b*. As can be seen by reference to FIG. 7, slots 83 have a relatively small angle with respect to the longitudinal axis of bottom wall 81*b*. When pivot bracket 81 is pivotally secured in position in seat support stretcher assembly 70, helical slots 83 line up above slots 75, with bottom wall 81*b* possibly but not necessarily contacting bottom wall 74*a* of front piece 74 of seat support assembly 70. However, slots 83 are slanted relative to slots 75 such that they overlap only at selected points at any given time.

The particular points at which slots 83 line up with slots 75 is determined by adjustment slide 90 (FIGS. 2, 4, 13 and 14). Adjustment slide 90 comprises a flat bottom plate 91 having a gripper flange 92 projecting downwardly from the bottom thereof. Protruding upwardly from bottom plate 91 are a pair of spaced bolts 93. Bottom plate 91 including gripper 92 is molded of plastic, and bolts 93 are square cross section shoulder bolts which are molded in place in the plastic. A raised locating shoulder 96 around each bolt 93 is also integrally molded of the plastic material with plate 91 and gripper 92.

In assembly, bolts 93 project upwardly through slots 75 and 83, with each locating shoulder 96 fitting snugly within one of said slots 75 in the bottom wall 74*a* of front piece 74 of seat support assembly 70. More specifically, the square cross sectioned shank 95 of each bolt 93 extends upwardly through the slot 88 in a molded plastic pivot bracket insert 86 (FIGS. 9–12 as well as FIGS. 1, 2, and 4). Pivot bracket inserts 86 are made of a self lubricating type of plastic such as a glass reinforced nylon in order to minimize friction in the seat adjustment assembly. It will be noted that each insert 86 is cylindrical in cross-sectional configuration so that it seats snugly against the cylindrical cross-sectional configuration of the bottom wall 81*b* of pivot bracket 81. The slot 88 in pivot bracket insert 86 is similarly helical in shape so that it matches with slot 83. It will be further noted that each slot 88 is framed by a peripheral, downwardly projecting lip 87 which actually extends into and through the receiving slot 83. The helical configuration of lip 87 can be appreciated by reference to the three cross sections shown in FIGS. 10, 11 and 12.

Figure 13:
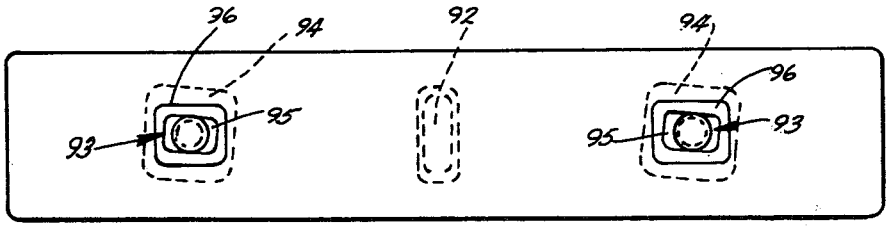
FIG. 13 is a top plan view of the seat adjustment slide 90.
Figure 14:
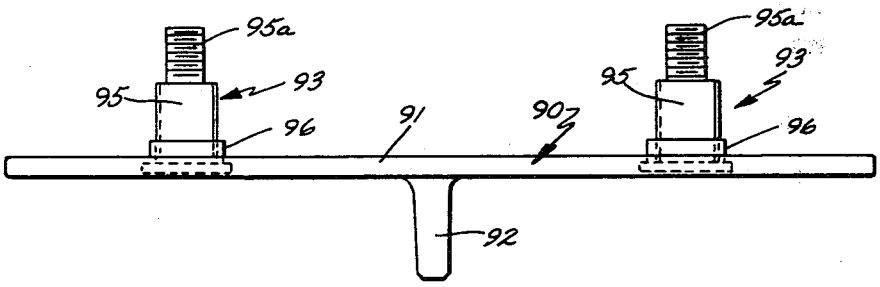
FIG. 14 is a side elevational view thereof.

Because of the difference between the generally rectilinear slot 75 in seat support front piece 74 as distinguished from the helical slot 88 in pivot bracket inserts 86, it will be noted by reference to FIG. 13 that the plastic guide or locating shoulders 96 at the base of each upwardly projecting bolt 93 are generally rectangular in configuration and are oriented parallel to the longitudinal axis of seat adjustment slide 90. Thus, these locating shoulders 96 sit nicely in slots 75 and slide readily from one end thereof to the other.

However, the generally rectangular shank or shoulder 95 of shoulder bolts 93 are cocked at a slight angle with respect to the longitudinal axis of slide 90. This is accomplished by embedding shoulder bolts 93 at a cocked angle that can be seen from the outline of the heads 94 of the bolts which are embedded in the plastic of bottom plate 91. These cocked, generally rectangular shanks or shoulders 95 then fit readily into slots 88 and slide readily along the length thereof.

Projecting upwardly from the cocked shoulder 95 of bolts 93 are the threaded upper ends 95*a*. Referring to FIGS. 1, 2 and 4, it will be understood that a washer of generally solid semi-cylindrical, lateral cross section fits over the threaded portion 95*a* of each bolt 93 and the cylindrical wall portion of each washer 97 seats down in the cylindrical nest defined by pivot bracket inserts 86. Flanged nuts 98 are then threaded down onto threaded ends 95*a* of bolts 93. The components are dimensioned such that washer 97 rests on top of shoulder or shank 95 without tightening pivot bracket inserts 86 and pivot bracket 81 too tight against the bottom wall 74*a* of seat stretcher front piece 74. This allows one to slide seat adjustment slide 90 to the left or to the right relative to the front of chair control 1, thereby changing that portion of slots 88 and 83 which overlie the longitudinally oriented slots 75 of seat stretcher front piece 74. In effect, this causes pivot bracket 81 to rotate about its pivotal mounting via nut, washer and bolt assemblies 82 to seat stretcher assembly 70. Such rotation shifts the elevation of the left end of each leg 81*a* of pivot bracket 81 with respect to the side stretchers 70*a* of seat stretcher assembly 70.

It will be noted that the angle of slots 83 with respect to the longitudinal axis of bottom wall 81*b* is relatively small, whereby adjustment slide 90 can be slid manually without the need for any device to give the operator any mechanical advantage to slide it, and whereby once moved, slide 90 does not tend to slide along slots 83 when weight is placed on a chair seat mounted on control 1. If slots 83 were oriented at a large angle to the longitudinal axis, i.e., at a small angle to a vertical plane through the fore-aft axis of control 1, one would need some device giving one substantial mechanical advantage in order to move slide 90 to the right or left. Further, one would need means for locking slide 90 in place. Otherwise, weight on the chair seat would readily force slide 90 back to the bottom of slots 83. In essence one would have a totally different type of seat adjustment mechanism.

The purpose of this change in elevation is to change the effective angle or elevation of the front of a chair seat mounted on chair control 1. Located at the left end as viewed in FIGS. 2, 4 and 8 of pivot bracket 81 is an axle receiving hole 84. A front slide axle 89 extends through the axle receiving holes 84 in the opposite pivot bracket legs 81*a*. The ends of the axle 89 are carried in suitable bearings 89*a*.

Axle 89 passes through the lateral openings in track brackets 20 at the front of stationary control housing 10 whereby pivot bracket 81 is pivotally mounted to stationary housing 10. Within the confines of each track bracket 20, axle 89 is carried in a plastic bushing 99 of generally rectangular cross section (FIGS. 1 and 2). Retainer clips or rings 99*a* (FIG. 1) hold the plastic bushing 99 and axle 89 in position within track brackets 99. With the ends of pivot bracket legs 81*a* thus assembled to the front of stationary control housing 10, the pivoting of pivot bracket 81 by changing the position of slide 90 thereby changes the elevation of the front of seat support assembly 70 with respect to the front of stationary control housing 10. This then facilitates adjustment of the seat angle by the user of the chair to which chair control 1 is mounted.

In the broader aspects of this invention, stationary housing 10 and back supports 60 can be viewed as a single support assembly with seat supports 70 pivotally joined thereto. Even if there were no provision for seat tilting, this invention could be used in the broadest sense to simply adjust seat angle with respect to a support means or assembly.

Bushings 99 are preferably formed of a self-lubricating plastic material of the type commonly used to minimize friction. An example of such a plastic would be the acetal type, available from Dupont as "Delrin" TM and from Celanese as "Celcon" TM. This enables bushings 99 to slide along the length of track brackets 20.

Such sliding action takes place when the user of a chair to which chair control 1 is mounted leans back in the chair. In leaning back, he causes chair back support arms 90 to pivot about their pivot point with respect to stationary housing 10. Similarly, chair seat support assembly 70 tilts rearwardly since it is pivotally connected directly to back support arms 60 at axle 68. At the same time, front axle 89 and bushings 99 slide rearwardly within track brackets 20. The enlarged openings 73 in the side stretchers 70*a* allow clearance for the ends of axle 89 to move up and down and slide. A comparison of chair control 1 in its untilted and tilted back positions respectively can be seen by comparing FIGS. 2 and 3.

Also, the sliding interconnection between stationary member 10 and pivot axle 89 allows pivot axle 89 to shift as pivot bracket 81 is rotated. At some point, there has to be means allowing at least one connection between said housing 10 to shift vis-a-vis seat support 70 when pivot bracket 81 is rotated.

If the chair user wishes to change the angle of the chair seat, he simply reaches under the seat, grasps gripper 92 and moves adjustment slide 90 to either the left or right, depending on which way he wants to adjust the seat angle. This movement causes upwardly projecting bolts 93 to slide in slots 75 of seat support stretcher assembly 70 and in helical slots 88 and 83 of pivot bracket inserts 86 and pivot bracket 81 respectively. Because slots 88 and 83 are helical and thus skewed slightly with respect to slots 75, such movement of bolts 93 causes pivot bracket 81 to pivot about its pivot mountings 82, which in turn changes the elevation of front axle 89 with respect to the front of seat stretcher assembly 70. This, of course, results in changing the seat angle.

Of course, it is understood that the above is merely a preferred embodiment of the invention and that various changes and alterations can be made without departing from the spirit and broader aspects thereof as more particularly defined in the appended claims.

The embodiments of the invention in which an exclusive property or privilege is claimed are defined as follows:

1. A chair seat pitch adjustment assembly having first support means, a seat support member pivotally mounted with respect to said first support means at one point and adjustment means interconnecting said seat support with said first support means for adjusting the angle of said seat support member with respect to said first support means, the improvement in said assembly comprising: said adjustment means including a pivot bracket pivotally mounted to said first support means on one pivot axis and to said seat support member on a second pivot axis; said pivot bracket including a cylindrical wall extending generally laterally with respect to the sides of said seat support member, said cylindrical wall defining at least a portion of the wall of a right circular cylinder whose axis of revolution lies on said second pivot axis; said cylindrical wall including at least one helically oriented slot therein; a slide slidably mounted on said seat support member for generally lateral movement with respect to the sides of said seat support member, said slide including projection means projecting through said helical slot in said cylindrical wall whereby as said slide is moved laterally, said cylindrical wall and therefore said pivot bracket are rotated about said second pivot axis, thereby changing the relative elevation of said first pivot axis with respect thereto and thereby changing the pitch of said seat support member with respect to said first support means; means allowing at least one of said pivotal mountings between said seat support member and said first support means, said seat support member and said pivot bracket and said pivot bracket and said first support means to shift when said pivot bracket is rotated; said seat support member including a wall having a generally rectilinear slot therein extending generally laterally with respect to the sides of said seat support member; said projection means on said slide extending through said generally rectilinear slot; and an insert of semi-cylindrical configuration corresponding to the configuration of said cylindrical wall and being seated therein, said insert including a helical slot therein aligned with said helical slot in said cylindrical wall.

2. The adjustment assembly of claim 1 in which said projection means includes a locating shoulder of generally rectangular lateral cross section with sides oriented generally parallel to said generally rectilinear slot, said shoulder being received in said generally rectilinear slot; said projection means including a second shoulder of generally rectangular lateral cross section and having sides oriented at an angle with respect to said sides of said first shoulder and generally parallel to the sides of said helical slot as projected into a plane, said second shoulder being received within said helical slot.

3. The adjustment assembly of claim 2 in which said slide and said insert comprise molded plastic members and said projection means comprises a shoulder bolt having a head embedded in said plastic slide.

4. The seat adjustment assembly of claim 2 in which said slide is a molded plastic member and said projection means comprises a shoulder bolt having a head embedded in said plastic slide; said first shoulder being integrally molded of plastic with said slide and surrounding said shoulder bolt; said second shoulder comprising the shoulder of said shoulder bolt.

5. The seat adjustment assembly of claim 1 in which said pivot bracket is generally U-shaped, comprising a pair of spaced sidewalls joined by said cylindrical wall, said first and second pivot axes extending through said sidewalls of said pivot bracket.

6. The adjustment assembly of claim 5 in which there are two of said helical slots in said cylindrical wall, said slots being spaced laterally from one another with respect to said sidewalls and being oriented generally parallel to one another; there being two of said projection means on said slide, one projecting through each of said helical slots.

7. The adjustment assembly of claim 1, 2, 3, 4, 5 or 6 in which said slide includes a gripping flange projecting downwardly therefrom whereby a user can readily grasp said gripping flange and slide said slide one way or another.

8. The adjustment assembly of claims 1, 2, 3, 4, 5 or 6 in which said means allowing shifting comprises means allowing said first pivot axis to shift.

9. The adjustment assembly of claim 8 in which said first pivot axis comprises an axle mounted in bushings; said first support means including a track means receiving said bushings, said bushings being slidably received within said track means.

* * * * *

UNITED STATES PATENT AND TRADEMARK OFFICE

CERTIFICATE OF CORRECTION

PATENT NO. : 4,375,301

DATED : March 1, 1983

INVENTOR(S) : Charles C. Pergler et al

It is certified that error appears in the above-identified patent and that said Letters Patent is hereby corrected as shown below:

Column 6, line 38:

"99" should be --20--

Column 8, line 1:

after "member" delete "and said pivot bracket"

Signed and Sealed this

*Sixteenth* Day of *August 1983*

[SEAL]

*Attest:*

GERALD J. MOSSINGHOFF

*Attesting Officer* *Commissioner of Patents and Trademarks*